US010882542B2

(12) United States Patent
Grahn et al.

(10) Patent No.: US 10,882,542 B2
(45) Date of Patent: Jan. 5, 2021

(54) ENERGY DISSIPATING DEVICE AND CONNECTION DEVICE COMPRISING SUCH AN ENERGY DISSIPATING DEVICE

(71) Applicant: Dellner Couplers AB, Falun (SE)

(72) Inventors: Arvid Grahn, Falun (SE); Anders Westman, Falun (SE)

(73) Assignee: Dellner Couplers AB, Falun (SE)

( * ) Notice: Subject to any disclaimer, the term of this patent is extended or adjusted under 35 U.S.C. 154(b) by 646 days.

(21) Appl. No.: 15/314,375

(22) PCT Filed: May 27, 2015

(86) PCT No.: PCT/EP2015/001080
§ 371 (c)(1),
(2) Date: Nov. 28, 2016

(87) PCT Pub. No.: WO2015/180839
PCT Pub. Date: Dec. 3, 2015

(65) Prior Publication Data

US 2017/0197641 A1 Jul. 13, 2017

(30) Foreign Application Priority Data

May 28, 2014 (EP) ..... 14001858

(51) Int. Cl.
*B61G 11/16* (2006.01)
*B61G 9/04* (2006.01)
*B61G 11/18* (2006.01)

(52) U.S. Cl.
CPC ..... *B61G 11/16* (2013.01); *B61G 9/04* (2013.01); *B61G 11/18* (2013.01)

(58) Field of Classification Search
CPC ..... B61G 7/10; B61G 11/16; B61G 11/14; B61G 11/18; B61G 9/04; B61D 15/06; F61F 7/125; B60R 19/34
See application file for complete search history.

(56) References Cited

U.S. PATENT DOCUMENTS 3,035,827 A * 5/1962 Peterson ..... F16F 9/486 105/392.5
5,443,146 A * 8/1995 Ayyildiz ..... B60R 19/36 188/371

(Continued)

FOREIGN PATENT DOCUMENTS

CN 201283874 Y 8/2009
CN 101801757 A 8/2010

(Continued)

OTHER PUBLICATIONS

International Search Report dated Aug. 25, 2015 for related PCT Application No. PCT/EP2015/001080.

*Primary Examiner* — Scott A Browne
(74) *Attorney, Agent, or Firm* — Howard IP Law Group, PC

(57) ABSTRACT

An energy dissipating device includes a guide defining a guide surface having a curved cross-section. A deformer is slideably supported by the guide surface of the guide in a compression stroke direction of the device. A stopper is fixedly attached to the device and arranged at a distance from the deformer in the compression stroke direction. An energy dissipating member is arranged between the stopper and the deformer in the compression stroke direction, and includes a first end configured to engage with the stopper and a second end configured to engage with the deformer in response to a force thereon in the compression stroke direction.

23 Claims, 3 Drawing Sheets

(56) References Cited

U.S. PATENT DOCUMENTS

| | | | | |
|---|---|---|---|---|
| 7,735,427 | B2 | 6/2010 | Gansweidt | |
| 7,766,403 | B2 * | 8/2010 | Alvarsson | B60R 19/56 293/133 |
| 2003/0209915 | A1 * | 11/2003 | Yoshida | B60R 19/34 293/133 |
| 2009/0065462 | A1 * | 3/2009 | Gansweidt | B61G 7/10 213/1 A |
| 2010/0237638 | A1 * | 9/2010 | Beika | B60R 19/34 293/129 |
| 2011/0233016 | A1 * | 9/2011 | Lim | B60R 19/34 188/374 |

FOREIGN PATENT DOCUMENTS

| | | | | |
|---|---|---|---|---|
| CN | 102700563 | A | 10/2012 | |
| DE | 4337257 | C1 | 4/1995 | |
| DE | 202 18 449 | U1 | 2/2003 | |
| DE | 102 44 330 | A1 | 4/2004 | |
| EP | 1 247 716 | A1 | 10/2002 | |
| EP | 1312527 | A1 | 5/2003 | |
| FR | 2350237 | A1 | 5/1977 | |
| FR | 2 644 744 | A1 | 9/1990 | |
| GB | 1 275 035 | A | 5/1972 | |
| GB | 1543289 | | 4/1979 | |
| GB | 2230839 | A | 10/1990 | |
| SI | 21092 | A | 6/2003 | |
| WO | 0209996 | A1 | 2/2002 | |
| WO | WO-0209996 | A1 * | 2/2002 | B61G 11/16 |
| WO | 2005075272 | A1 | 8/2005 | |

* cited by examiner

ENERGY DISSIPATING DEVICE AND CONNECTION DEVICE COMPRISING SUCH AN ENERGY DISSIPATING DEVICE

CROSS-REFERENCE TO RELATED APPLICATIONS

This application is a national phase application under 35 U.S.C. § 371 of International Patent Application No. PCT/EP2015/001080 filed May 27, 2015, which claims priority to European Application No. 14 001 858.1 filed May 28, 2014, the entire contents of all of which are incorporated herein by reference in their entireties for all purposes.

FIELD

The invention is directed to an energy dissipating device suitable to be used as part of a connection device that connects a first car of a multi-car vehicle with a second car of the multi-car vehicle. The invention is also directed to such a connection device.

BACKGROUND

From WO 2005/075272 A1 an energy dissipating device of a connection device that connects a first car of a multi-car vehicle with a second car of the multi-car vehicle is known. The energy dissipating device has an energy dissipating member in the form of a deformation tube that dissipates energy when it is deformed. The deformation tube has a flange arranged at a first end of the deformation tube, which is intended to rest against a panel of the first car. Arranged inside the deformation tube at the first end of the deformation tube is a deformer that has a mandrel arranged at its end that rests against a waist of the deformation tube whereby the diameter of the deformation tube is reduced at this waist.

From EP 1 312 527 A1 an energy dissipating device suitable to be used as part of a connection device that connects a first car of a multi-car vehicle with a second car of the multi-car vehicle is known. The connection device in this embodiment is designed as an articulated joint. The energy dissipating device arranged as part of the connection device has an energy dissipating member in the form of a deformation tube that dissipates energy when it is deformed. The deformation tube has a first end and a second end, the first end and the second end being spaced apart from each other in a compression stroke direction which is in line with the longitudinal axis of the articulated joint when it is in the straightened-out mode of operation. The energy dissipating device also has a stopper in the form of a pressure plate. The pressure plate has a stopping surface and the first end of the energy deformation tube is in contact with the stopping surface, the stopping surface preventing that the first end moves into the compression stroke direction, because the pressure plate is screwed to flange parts surrounding the deformation tube. The energy dissipating device furthermore has a deformer, which is called guiding profile (Führungsprofil) in EP 1 312 527 A1. At one end of the guiding profile a mandrel is provided that is in contact with the second end of the deformation tube and that is held apart from the pressure plate by the deformation tube, whereby the guiding profile can be moved towards the pressure plate by application of a linear force pointing in the compression stroke direction that is larger than a predetermined threshold value and whereby the guiding profile deforms the deformation tube when moving towards the pressure plate. The guiding profile is guided on straight-line rails provided at either side of the deformation tube in the flange parts that surround the deformation tube and to which the pressure plate is fastened by screws.

SUMMARY

Given this background, the problem to be solved by the invention is to improve the guidance of the deformer that guides the deformer to move in the compression stroke direction. This problem is solved by the subject matter disclosed in the description following hereafter.

The general concept of the invention is to provide a guide that interacts with the deformer to guide the deformer to move in the compression stroke direction, whereby the guide has a 3-dimensional guide surface that interacts with a surface of the deformer, whereby the guide surface extends in a direction parallel to the compression stroke direction and whereby the cross-section of the guide surface in a plane that is normal to the compression stroke direction has the form of an arc or the form of a ring. The shape of such a guide improves the take-up of moments about both axes that are perpendicular to the compression stroke direction.

In a preferred embodiment, the surface of the deformer that interacts with the guide extends in a direction parallel to the compression stroke direction and also has a cross-section in a plane that is normal to the compression stroke that has the form of an arc or the form of a ring. Forming the guide surface and the surface of the deformer that interacts with the guide surface in a like manner improves their interaction.

In a preferred embodiment, the guide surface is provided by the inward facing surface of a hollow cylinder. This has the advantage of allowing the guide surface to be manufactured in a more simple manner. Additionally, the use of a hollow cylinder to provide the guide surface provides the option that in a preferred embodiment the energy dissipating member is at least partially arranged inside the hollow cylinder. In an especially preferred embodiment, the energy dissipating member is fully received inside the hollow cylinder. Arranging the energy dissipating member inside a hollow cylinder provides advantages for handling the energy dissipating device as this can be assembled into a ready-to-use unit that can be easily attached to the cars of the multi-car vehicle. Additionally, arranging the energy dissipating member inside the hollow cylinder reduces the space taking up by the energy dissipating device. Furthermore, arranging the energy dissipating member inside a hollow cylinder allows the energy dissipating device to be integrated into a connection rod or a coupler rod of a connection device that connects a first car of the multi-car vehicle with a second car of the multi-car vehicle. Reducing the space taken up by the energy dissipating device also provides advantages, if the energy dissipating device is to be arranged in a space within the underframe of a car of a multi-car vehicle.

In a preferred embodiment, the stopper is provided by an inward-facing, ring-shaped body attached to one end of the hollow cylinder such as to partially block the opening of the hollow cylinder at one end, whereby the axially and inward-facing surface of the ring-shaped body provides the stopping surface. Using a ring-shaped stopper instead of a pressure plate like it is used in EP 1 312 527 A1 reduces the weight of the energy dissipating device as the weight of the stopper can be reduced. Additionally, the ring-shaped body can be attached to an end of the guide, especially to the end of a hollow cylinder by welding it to it or by manufacturing the hollow cylinder in such a manner that it has a step at one end, which step acts as stopper with an inward facing, ring-shaped body, whereby the axially and inward facing surface of this step provides the stopping surface. Furthermore, the use of a ring-shaped body allows in a preferred embodiment for the use of an energy dissipating member in the shape of a deformation tube which is pushed by the deformer applying a linear force to the second end of such a deformation tube and pushing the deformation tube through the hole in the ring-shaped body of the stopper, thereby deforming the deformation tube by radially compressing the deformation tube inwards. To improve the working of this specific design of an energy dissipating member, a mandrel can be arranged as part of the inward facing, ring-shaped body or the inward facing surface of the ring-shaped body that provides the stopping surface can be made to be at an angle of less than 90° to the compression stroke direction in order to facilitate the radially inward deformation of the deformation tube.

In a preferred embodiment, the deformer is provided by a second cylinder, whereby the outer diameter of at least a section of the second cylinder is substantially the same as the inner diameter of at least a section of the hollow cylinder and the second cylinder has a first end that is in contact with the second end of the energy dissipating member and the first end of the second cylinder is arranged inside the hollow cylinder such that at least that part of the outer surface of the second cylinder that has an outer diameter that is substantially the same as the inner diameter of at least a section of the hollow cylinder is guided by this section of the inner surface of the hollow cylinder. This embodiment provides advantages with regard to the manufacturing process for the guide and for the deformer, as both can be made from cylinders with appropriately synchronized outer and inner diameters. Additionally, this embodiment improves the integration of the energy dissipating device into a coupler rod or a connection rod of a connection device of a multi-car vehicle. Furthermore having the guide surface being the inner surface of a hollow cylinder and the surface of the deformer that interacts with the guide surface being a part of the circumferential surface of a second cylinder provides a good guidance of the deformer. Indeed, designs are possible, where the more the deformer has moved towards the stopper and thus the more the deformer has deformed the energy dissipating member, the larger the interacting surfaces become as the second cylinder that provides the deformer moves inwards into the hollow cylinder.

The second cylinder that provides the deformer can be a solid cylinder. To reduce the weight of the energy dissipating device and for further advantages and functions described further below, the second cylinder that provides the deformer preferably also is a hollow cylinder.

In a preferred embodiment the stopper is arranged at one end of the hollow cylinder and an inward facing ring-shaped body is attached to the opposite of the hollow cylinder, whereby the second cylinder has a stepped outer surface having a section with a larger outer diameter and a second with a smaller outer diameter with a step arranged between the section with the larger outer diameter and the section with the smaller outer diameter, whereby the section with a larger outer diameter is arranged inside the hollow cylinder and the step abuts the inward facing, ring-shaped body. In such an embodiment, the section with the larger outer diameter provides the surface of the deformer that interacts with the guide surface that is provided by the inward facing surface of the hollow cylinder. The interaction of the step with the inward facing, ring-shaped body limits the movement of the second cylinder away from the energy dissipating member and thus prevents the energy dissipating device from falling apart. By choosing the length of an energy dissipating member, for example a deformation tube, and by choosing the distance between the stopper arranged at one end of the hollow cylinder and the additional inward facing, ring-shaped body that is attached to the opposite end of the hollow cylinder as well as by choosing the size of the section with the larger outer diameter and thus the position of the step relative to the end of the second cylinder that is in contact with the second end of the deformation tube, the possibility arises to apply a pre-tension to the energy dissipating member.

In a preferred embodiment, the inward facing, ring-shaped body is a split nut. In an even preferred embodiment, the split nut is attached to the inner surface of the hollow cylinder by a locking wire. To receive the locking wire, the inner surface of the hollow cylinder has grooves with a cross-section of the shape of approximately half of a ring. The outward facing surface of the split nut has corresponding grooves that likewise have a cross-section with the shape of approximately a half of a ring. If a wire is positioned inside facing grooves of the inner surface of the hollow cylinder and the outer surface of the split nut, the interaction of the wire with the groove delimiting walls prevents movements perpendicular to the plane in which the grooves are arranged. The assembly of the split nut is facilitated, if the hollow cylinder has openings that are arranged between the outer circumference of the hollow cylinder and the grooves of the inner surface of the hollow cylinder. This allows the locking wire to be threaded through an opening to come into the space provided by the aligned grooves of the inner surface of the hollow cylinder and the outer surface of the split nut. The locking wire can then either be pushed further through the opening, such that it circulates once around the split nut and fully takes up the space provided by the grooves. Alternatively, the locking wire can be attached to the split nut or to the inner surface of the hollow cylinder and thus can be pulled in to the grooves by rotating the split nut relative to the hollow cylinder.

In a preferred embodiment, the second cylinder is a hollow cylinder that has a conically shaped, inward facing end-face that is in contact with the energy dissipating member and whereby the energy dissipating member is deformed radially inward when the deformer is moved towards the stopper by application of the linear force pointing in the compression stroke direction that is larger than the predetermined threshold value, while the deformer moves along the energy dissipating member and takes up the radially inwardly deformed part of the energy dissipating member inside the hollow space inside the second cylinder that provides the deformer. Especially for the embodiments where a deformation tube is used as energy dissipating member, this embodiment provides the advantage that the energy dissipating member can be taken up inside the second cylinder (the deformer) while the deformer moves along the energy dissipating member towards the stopper. In comparison to other embodiments, where a deformation tube is pushed by the deformer through a ring-shaped stopper, the design of taking up the energy dissipating member inside the second hollow cylinder that provides the deformer prevents parts of the energy dissipating member to stick out at the end of the energy dissipating device. This provides the advantage that the energy dissipating devices remains a unit and can be disconnected from a connection device more easily. Additionally, no further space needs to be provided around the energy dissipating device to allow for the energy dissipating member that is pushed out of the energy dissipating device.

In an alternative embodiment, the second cylinder, which in this embodiment can also be a hollow cylinder, but also can be a solid cylinder, has a conically shaped, outward facing end-face that is in contact with the energy dissipating member and arranged inside an end-opening of the energy dissipating member. In this embodiment, the energy dissipating member is deformed radially outward when the deformer is moved towards the stopper by application of the linear force pointing in the compression stroke direction that is larger than the predetermined threshold value. This embodiment can for example by implemented with a deformation tube and the deformer being pushed into the deformation tube similar to the manner how the deformation tube in EP 1 312 527 A1 is deformed. In this design, the surface of the deformer that interacts with the guide surface needs to be spaced apart from the conically shaped, outward facing end-face that is in contact with the energy dissipating member. This can for example be achieved by providing a ring-shaped slit between that part of the deformer that provides the conically shaped, outward facing end-face and an additional part of the deformer that provides the surface that interacts with the guide surface, the additional part being connected to the part that provides the conically shaped, outward facing end-face at an end section of the deformer that is at the opposite end relative to the end that has the conically shaped, outward facing end-face.

In a preferred embodiment, a mandrel is arranged at one end of the second cylinder. This mandrel can provide the conically shaped, inward facing end-face of the conically shaped, outward facing end-face, respectively, for the above described embodiments. Using a mandrel at one end of the second cylinder allows this mandrel to be of different material than the second cylinder which can be advantageous to provide strength to deform the energy dissipating member.

In a preferred embodiment, an inward facing rib is arranged on the inner surface of the hollow cylinder that extends in the direction of the longitudinal axis of the hollow cylinder and a groove is arranged on the outer surface of the second cylinder that extends in the direction of the longitudinal axis of the second cylinder and engages with the rib. Such an embodiment prevents the second cylinder to rotate relative to the hollow cylinder when the deformer moves towards the stopper. Alternatively or in addition, an outward facing rib can be provided in an embodiment, which outward facing rib is arranged on the outer surface of the second cylinder that extends in the direction of the longitudinal axis of the second cylinder and a groove is arranged on the inner surface of the hollow cylinder that extends in the direction of the longitudinal axis of the hollow cylinder and engages with the rib. This design also prevents a rotation of the hollow cylinder relative to the second cylinder.

In a preferred embodiment, the energy dissipating member is a deformation tube, especially a deformation tube that is deformed radially inward or deformed radially outward by the deformer when the deformer is moved towards the stopper. It is expected that the use of a deformation tube within the invention provides the best use of the invention, especially for the embodiments where the guide surface is provided by an inward facing surface of a hollow cylinder and especially for those embodiments, where the guide surface is provided by the inward facing surface of a hollow cylinder and the deformer is provided by a second cylinder. In these embodiments, the use of a deformation tube allows the design to be very symmetric. As alternatives, honeycomb-elements can be used as energy dissipating members.

In a preferred embodiment, the second cylinder has a stopper surface arranged on the outer circumference of the second cylinder and facing towards the hollow cylinder that limits the way that the second cylinder can be pushed into the hollow cylinder.

The connection device according to the invention is suitable to connect a first car of a multi-car vehicle with a second car of the multi-car vehicle and comprises a connection rod or an articulated joint. According to the invention, the energy dissipating device of the invention forms part of the connection rod or the coupler rod or the joint part, which includes the arrangement of the energy dissipating device behind the bearing bracket of a joint.

The energy dissipating device and the connection device according to the invention are preferably used in a multi-car vehicle and connect a first car of the multi-car vehicle with a second car of the multi-car vehicle. In a preferred embodiment, the energy dissipating device and the connection device according to the invention are used to connect a first car of a train with a second car of a train. The energy dissipating device and the connection device can be used for railway-bound trains (street cars and subway-trains also being considered as such trains). They can also be used for magnetic railway trains or for busses (road busses as well as busses travelling on fixed tracks).

The description above describes the preferred embodiments mainly in conjunction with the guide surface being provided by the inward facing surface of a hollow cylinder, thus by a guide that has a 3-dimensional guide surface that in a plane that is not normal to the compression stroke direction has the form of a ring. This focus on the hollow cylinder providing the guide surface by its inward facing surface does not limit the embodiments of the invention to this design. The advantages described for the preferred embodiments above can also be achieved by a guide that has a 3-dimensional guide surface that in a plane that is normal to the compression stroke direction has the form of an arc.

BRIEF DESCRIPTION OF THE DRAWINGS

Below, the invention will be described with reference to drawings that only show exemplatory embodiments of the invention. In the drawings

DETAILED DESCRIPTION

Figure 1:
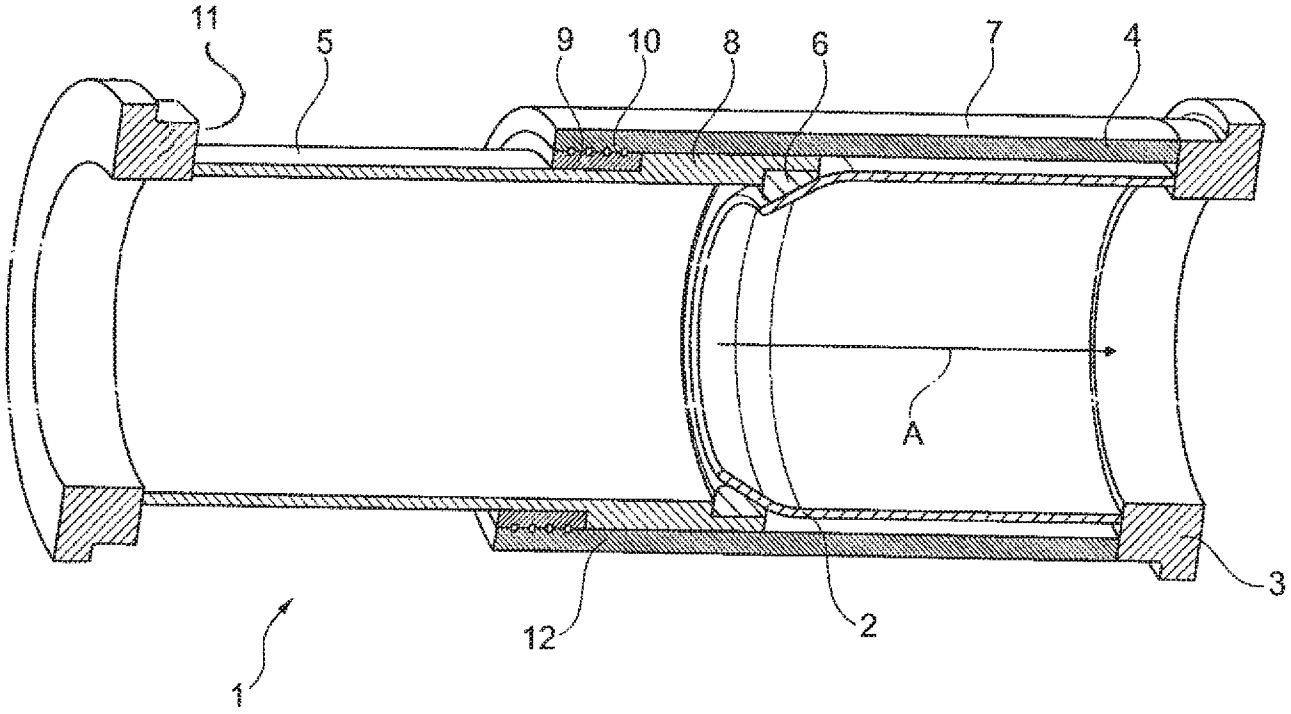
FIG. 1 shows a perspective sectional side view onto a first embodiment of the invention and FIG. 2 shows a perspective view from the outside onto a second embodiment of the invention.

The energy dissipating device 1 shown in FIG. 1 has an energy dissipating member 2 in the form of a deformation tube which dissipates energy when it is deformed. The energy dissipating member 2 has a first (right) end and a second (left) end, the first end and the second end being spaced apart from each other in a compression stroke direction A. A stopper 3 by way of an inward facing, ring-shaped body attached to one end of a hollow cylinder 4 that partially blocks the opening of the hollow cylinder 4 at that one end is provided. The stopper 3 has a stopping surface provided by the axially and inward facing surface of the ring-shaped body. The first (right) end of the energy dissipating member 2 is in contact with the stopping surface, the stopping surface preventing that the first (right) end moves into the compression stroke direction A. Additionally, a deformer in the shape of a second hollow cylinder 5 is provided that is in contact with the second (left) end of the energy dissipating member 2 and is held apart from the stopper 3 by the energy dissipating member 2. The deformer 5 can be moved towards the stopper 3 by application of a linear force pointing into the compression stroke direction A that is larger than a predetermined threshold value. When the deformer 5 moves towards the stopper 3, the deformer deforms the energy dissipating member 2 by way of deforming the deformation tube radially inward and taking up the deformed part of the energy dissipating member 2 inside the hollow space inside the deformer 5. To facilitate the deformation of the energy dissipating member 2, the deformer 5 has a mandrel 6 arranged at its end that is in contact with the second (left) end of the energy dissipating member 2.

A guide 7 is provided by means of the hollow cylinder 4, whereby the guide 7 interacts with the deformer 5 to guide the deformer 5 to move into the compression stroke direction A. The guide 7 has a 3-dimensional guide surface that interacts with a surface of the deformer 5, whereby the guide surface is provided by the inner surface of the hollow cylinder 4. The surface of the deformer that interacts with the guide surface is provided by the outer circumferential surface of a section 8 of the deformer 5 with a larger diameter compared to other parts of the deformer 5 that have a smaller diameter.

The interaction of the inward facing surface of the hollow cylinder 4 with the outward facing circumferential surface of the portion of the deformer 5 with larger diameter allows for a good guidance of the deformer. Especially, the guide is well-suited to take up moments around the two axes perpendicular to the compression stroke direction A.

As can be seen from FIG. 1, the energy dissipating member 2 is fully arranged inside the hollow cylinder.

The hollow cylinder 4 has an inward facing, ring-shaped body 9 in the form of a split nut that is attached to the opposite end of the hollow cylinder relative to the stopper. The deformer 5 has a stepped outer surface having a section 8 with a larger outer diameter and a section with a smaller outer diameter with a step arranged between the section 8 with the larger outer diameter and a section with the smaller outer diameter, whereby the section 8 with a larger outer diameter is arranged inside the hollow cylinder 4 and the step abuts against the inward facing, ring-shaped body 9. The inward facing, ring-shaped body 9 in the form of the split nut is attached to the inner surface of the hollow cylinder by a locking wire 10. To receive the locking wire 10, the inner surface of the hollow cylinder has grooves with a cross-section of the shape of approximately half of a ring. The outward facing surface of the split nut has corresponding grooves that likewise have a cross-section with the shape of approximately a half of a ring. With the locking wire 10 being positioned inside facing grooves of the inner surface of the hollow cylinder and the outer surface of the split nut, the interaction of the locking wire 10 with the groove delimiting walls prevents movements perpendicular to the plane in which the grooves are arranged.

FIG. 1 also shows that the second cylinder has a stopper surface 11 arranged on the outer circumference of the second cylinder and facing towards the hollow cylinder 4 that limits the way that the second cylinder can be pushed in the hollow cylinder 4.

An inward facing rib 12 is arranged on the inner surface of the hollow cylinder 4 that extends in the direction of the longitudinal axis of the hollow cylinder 4. A groove is arranged in the portion 8 of the deformer that has a larger diameter, said groove also extending in the longitudinal axis of the second cylinder. The rib 12 engages with this groove and thus prevents the second cylinder from rotating relative to the hollow cylinder 4.

Figure 2:
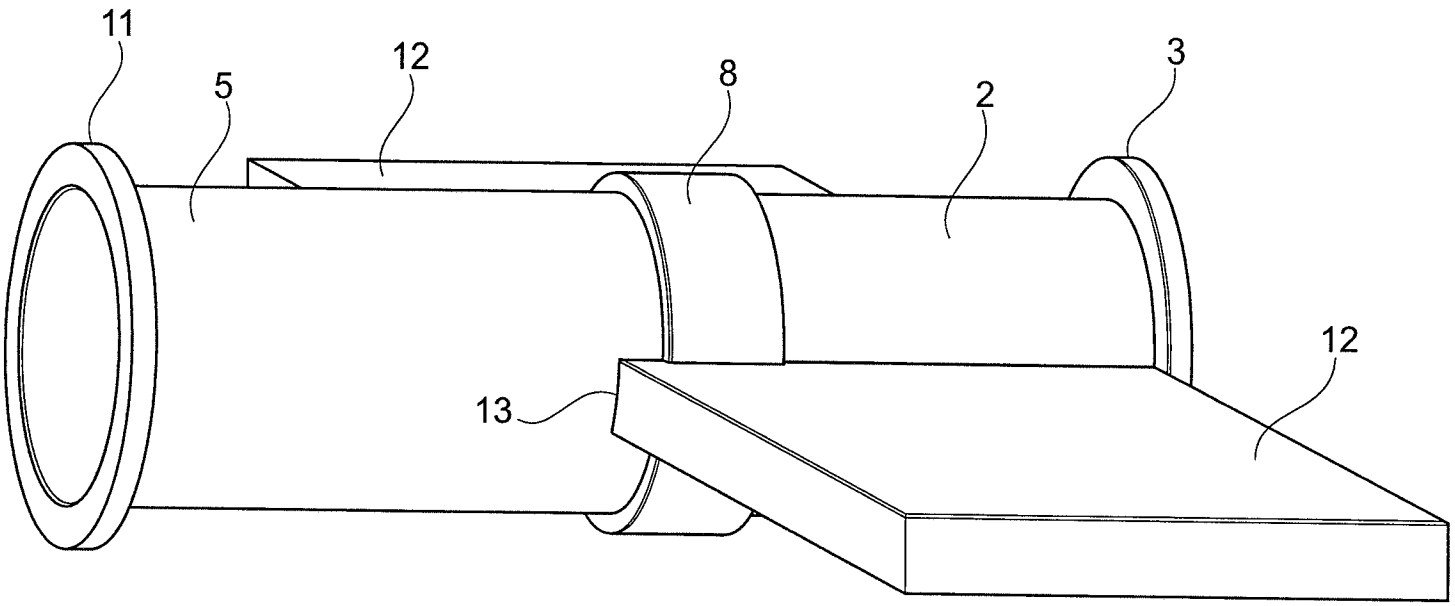

FIG. 2 shows a second embodiment of the invention. Like parts have been identified by using the same reference signs as used in the embodiment of FIG. 1. The embodiment shown in FIG. 2 differs from the embodiment shown in FIG. 1 in that the hollow cylinder 4 that provided the guide for the deformer has been replaced by two guide bodies 12, one being arranged on either side of the deformer 5. The guide bodies 12 provide a guide that has a 3-dimensional guide surface 13 that interacts with a surface of the deformer 5, whereby the guide surface extends in a direction parallel to the compression stroke direction A and the cross-section of the guide surface 12 in a plane that is normal to the compression stroke direction has the form of an arc.

Figure 3:
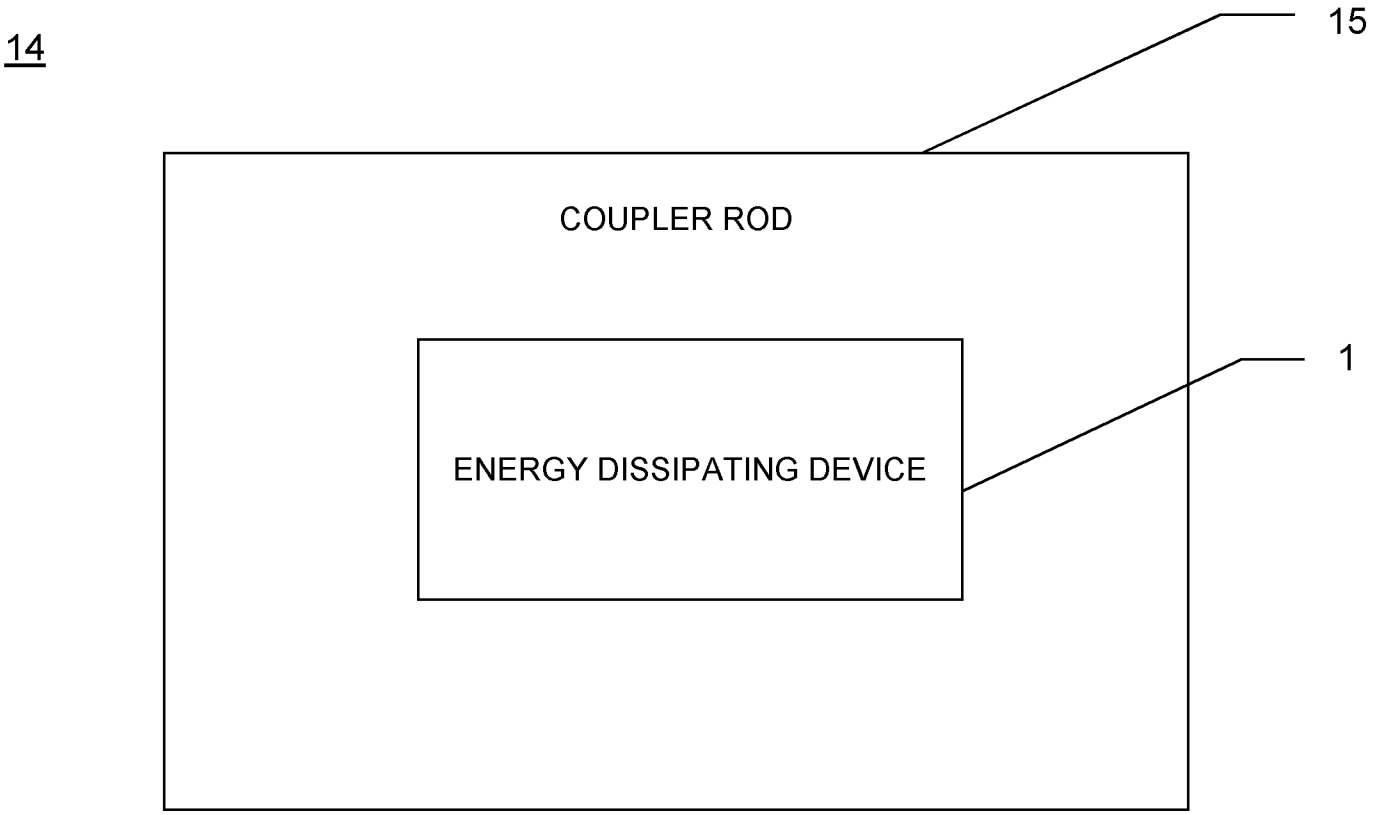
FIG. 3 shows a block diagram of a connection device for connecting a first car of a multi-car vehicle with a second car of the multi-car vehicle.

FIG. 3 is a block diagram that depicts a connection device 14 comprising a first part comprising one of a connection rod, a coupler rod, or an articulated joint 15, and a second part, integrated into the first part, comprising an energy dissipating device 1. Arranging the energy dissipating member inside a hollow cylinder allows the energy dissipating device to be integrated into a connection rod or a coupler rod of a connection device that connects a first car of the multi-car vehicle with a second car of the multi-car vehicle. Reducing the space taken up by the energy dissipating device also provides advantages, if the energy dissipating device is to be arranged in a space within the underframe of a car of a multi-car vehicle.

The invention claimed is:

1. An energy dissipating device for use in a device for connecting a first car of a multi-car vehicle to a second car of the multi-car vehicle, comprising:

an energy dissipating member comprising a first end and a second end spaced apart from one another in a compression stroke direction;

a stopper defining a stopping surface configured to engage the first end of the energy dissipating member for preventing movement of the energy dissipating member in the compression stroke direction;

a deformer arranged adjacent the second end of the energy dissipating member; and a guide defining a guide surface slideably supporting the deformer in the compression stroke direction, wherein the guide surface extends in a direction of the compression stroke and comprises a curved cross-section in a plane normal to the compression stroke direction, and wherein a portion of the guide surface extending in the compression stroke direction is configured for surface to surface contact with an outer surface of the deformer;

wherein the stopper comprises a ring-shaped body attached to an open end of the guide; and wherein the energy dissipating member is configured to deform radially inward when the deformer is urged towards the stopper by an application of a linear force acting in the compression stroke direction.

2. The energy dissipating device of claim 1, wherein the deformer is configured to be moved towards the stopper in response to the application of the linear force in the compression stroke direction that is larger than a predetermined threshold value at which the deformer deforms the energy dissipating member.

3. The energy dissipating device of claim 1, wherein the curved cross-section comprises a circular cross-section.

4. The energy dissipating device of claim 3, wherein the guide surface comprises an inward facing surface of a hollow cylinder defining the guide.

5. The energy dissipating device of claim 4, wherein the energy dissipating member is at least partially arranged inside the hollow cylinder.

6. The energy dissipating device of claim 4, wherein the stopper is sized so as to partially block the open end of the hollow cylinder.

7. The energy dissipating device of claim 4, wherein the deformer comprises a second cylinder having an outer diameter in at least one section that is substantially the same as an inner diameter of at least one section of the hollow cylinder.

8. The energy dissipating device of claim 7, wherein the second cylinder is a hollow cylinder that has a conically shaped, inward facing end-face in contact with the energy dissipating member.

9. The energy dissipating device of claim 8, further comprising a second stopper comprising a ring-shaped body attached to an end of the deformer opposite the inward facing end-face, wherein the second stopper includes a stopper surface that extends beyond an outer circumference of the second cylinder and opposes a portion of the guide for limiting a distance the second cylinder can be pushed into the guide.

10. The energy dissipating device of claim 1, wherein, when the energy dissipating device is in an uncompressed state, the deformer extends in the compression stroke direction beyond an end of the guide distant from the stopper in the compression stroke direction.

11. The energy dissipating device of claim 1, wherein, when the deformer is moving in the compression stroke direction to deform the energy dissipating member, the guide surface remains in contact with an outer surface of the deformer.

12. An energy dissipating device, comprising:

a guide defining a guide surface having a curved cross-section;

a deformer slideably supported by the guide surface of the guide in a compression stroke direction of the device;

a stopper fixedly attached to the device and arranged at a distance from the deformer in the compression stroke direction; and an energy dissipating member arranged between the stopper and the deformer in the compression stroke direction, the energy dissipating member comprising a first end configured to engage with the stopper and a second end configured to engage with the deformer in response to a force thereon in the compression stroke direction, wherein the deformer deforms the energy dissipating member by compressing the energy dissipating member radially inwards when moving towards the stopper to the extent that the energy dissipating member is partially received within the deformer; and wherein the stopper comprises a ring-shaped body attached to an open end of the guide.

13. The energy dissipating device of claim 12, wherein the curved cross-section of the guide surface comprises a circular cross-section.

14. The energy dissipating device of claim 13, wherein the guide surface comprises an inward facing surface of a hollow cylinder defining the guide.

15. The energy dissipating device according to claim 14, wherein the energy dissipating member is at least partially arranged inside the hollow cylinder.

16. The energy dissipating device of claim 15, wherein the deformer comprises a second cylinder having an outer diameter in at least one section that is substantially the same as an inner diameter of at least one section of the hollow cylinder.

17. The energy dissipating device of claim 12, wherein the energy dissipating member comprises a hollow deformation tube.

18. An energy dissipating device suitable to be used as part of a connection device that connects a first car of a multi-car vehicle with a second car of the multi-car vehicle, comprising:

an energy dissipating member that dissipates energy when it is deformed, the energy dissipating member having a first end and a second end, the first end and the second end being spaced apart from each other in a compression stroke direction;

a stopper defining a stopping surface, wherein when the first end of the energy dissipating member is in contact with the stopping surface, the stopping surface preventing motion of the first end in the compression stroke direction;

a deformer for contacting the second end of the energy dissipating member and held apart from the stopper by the energy dissipating member, wherein the deformer can be moved towards the stopper by an application of a linear force pointing in the compression stroke direction that is larger than a predetermined threshold value and wherein the deformer deforms the energy dissipating member by radially compressing the energy dissipating member inwards when moving towards the stopper; and a guide supporting the deformer so as to guide the deformer to move in the compression stroke direction, the guide comprising a three-dimensional guide surface supporting a surface of the deformer, wherein the guide surface extends in a direction parallel to the compression stroke direction and that the cross-section of the guide surface in a plane that is normal to the compression stroke direction has the form of an arc or the form of a ring.

19. The energy dissipating device according to claim 18, wherein the guide surface is provided by an inward facing surface of a hollow cylinder, wherein the energy dissipating member is at least partially arranged inside the hollow cylinder, and wherein the deformer comprises a second cylinder having an outer diameter in at least one section that is substantially the same as an inner diameter of at least one section of the hollow cylinder.

20. The energy dissipating device according to claim 19, wherein the stopper comprises a ring-shaped body attached to and at least partially blocking an open end of the hollow cylinder, wherein an axially and inward facing surface of the ring-shaped body defines the stopping surface.

21. The energy dissipating device according to claim 20, wherein the stopper is arranged at one end of the hollow cylinder and an inward facing, ring-shaped body is attached to the opposite end of the hollow cylinder, and wherein the second cylinder has a stepped outer surface having a section with a larger outer diameter and a section with a smaller outer diameter with a step arranged between the section with the larger outer diameter and the section with a smaller outer diameter, wherein the section with a larger outer diameter is arranged inside the hollow cylinder and the step abuts against the inward facing, ring-shaped body.

22. The energy dissipating device according to claim 21, wherein the inward facing, ring-shaped body is a split nut attached to the inner surface of the hollow cylinder by a locking wire.

23. A connection device for connecting a first car of a multi-car vehicle with a second car of the multi-car vehicle, comprising:

a first part, comprising one of a connection rod, a coupler rod, or an articulated joint; and a second part, integrated into the first part, comprising an energy dissipating device, the energy dissipating device comprising:

an energy dissipating member comprising a first end and a second end spaced apart from one another in a compression stroke direction;

a stopper defining a stopping surface configured to engage the first end of the energy dissipating member for preventing movement of the energy dissipating member in the compression stroke direction;

a deformer arranged adjacent the second end of the energy dissipating member; and a guide defining a guide surface slideably supporting the deformer in the compression stroke direction, wherein the guide surface extends in a direction of the compression stroke and comprises a curved cross-section in a plane normal to the compression stroke direction, and wherein a portion of the guide surface extending in the compression stroke direction is configured for surface to surface contact with an outer surface of the deformer;

wherein the stopper comprises a ring-shaped body attached to an open end of the guide; and wherein the energy dissipating member is configured to deform radially inward when the deformer is urged towards the stopper by an application of a linear force acting in the compression stroke direction.

* * * * *